US011241593B2

(12) United States Patent
Maglinti

(10) Patent No.: US 11,241,593 B2
(45) Date of Patent: Feb. 8, 2022

(54) LASH CLEANSING SLIPS

(71) Applicant: Robin Sheriden Marie Maglinti, Lihue, HI (US)

(72) Inventor: Robin Sheriden Marie Maglinti, Lihue, HI (US)

( * ) Notice: Subject to any disclaimer, the term of this patent is extended or adjusted under 35 U.S.C. 154(b) by 0 days.

(21) Appl. No.: 16/594,940

(22) Filed: Oct. 7, 2019

(65) Prior Publication Data

US 2020/0398086 A1 Dec. 24, 2020

Related U.S. Application Data

(60) Provisional application No. 62/864,440, filed on Jun. 20, 2019.

(51) Int. Cl.
*A47L 13/10* (2006.01)
*A61Q 1/14* (2006.01)

(52) U.S. Cl.
CPC ..... *A61Q 1/14* (2013.01); *A45D 2200/1063* (2013.01)

(58) Field of Classification Search
CPC ..... A61Q 1/14; A45D 2200/1063
USPC ..... 15/227, 104.93, 118, 209.1
See application file for complete search history.

(56) References Cited

U.S. PATENT DOCUMENTS 5,694,659 A * 12/1997 Merrion ..... G02C 13/006 15/104.93
8,544,135 B2 * 10/2013 Scott ..... A47L 13/18 15/104.93
D693,530 S * 11/2013 Seehoff ..... D32/35
2010/0269283 A1 * 10/2010 Shim ..... A61K 8/8111 15/209.1
2015/0096162 A1 * 4/2015 Hutter ..... B08B 1/00 29/428

FOREIGN PATENT DOCUMENTS

JP 2004-188189 * 7/2004 ..... A45D 44/00

* cited by examiner

*Primary Examiner* — Joseph J Hail
*Assistant Examiner* — Shantese L McDonald
(74) *Attorney, Agent, or Firm* — Michael L. Greenberg, Esq.; Greenberg & Lieberman, LLC

(57) ABSTRACT

A lash cleansing slip apparatus and cleaning system is described. The lash cleansing slip is configured to facilitate the safe and effective cleaning of make-up such as mascara, eyeliner, and similar cosmetics from the eye region of a user. The apparatus is equipped with specially designed holes configured to accommodate an index finger and a thumb of a user to facilitate the cosmetic removal. A front of the apparatus is preferably padded and is designed to be the cleaning face of the apparatus to be applied to the eyelid and eyelashes of the user while minimizing irritation of the eyes. Consistent use of the apparatus, in contrast to conventional cleansing wipes, is envisioned to minimize the creation of wrinkles of the eye region over time.

5 Claims, 3 Drawing Sheets

LASH CLEANSING SLIPS

CONTINUITY

This application is a non-provisional patent application of provisional patent application No. 62/864,440, filed on Jun. 20, 2019, and priority is claimed thereto.

FIELD OF THE PRESENT INVENTION

The present invention relates to the field of cosmetic care, and more specifically relates to a new apparatus and system configured to facilitate the removal of make-up and particles from eyelashes and eyelids to ensure proper care and eyelash maintenance.

BACKGROUND OF THE PRESENT INVENTION

It is known that traditional make-up removal wipes configured for use on the eye-area of the face of a user require the customer to wipe the entire eye area in order to sufficiently remove unwanted mascara. Such conventional make-up removal wipes require the use to continuously rub the eye-area with the wipe, which can damage the sensitive skin around the eyes. Additionally, conventional make-up removal wipes cause redness of the eye, and may help to exacerbate the creation of wrinkles near the eyes from repetitive rubbing over time.

If there were a way in which users could remove unwanted make-up, mascara, and other eye products from the lashes and surrounding eye-area effectively without excessive rubbing, redness would be reduced, and preemptive wrinkles could be eliminated.

Thus, there is a need for a new form of lash cleaning apparatus configured to facilitate the removal of make-up, mascara, and similar eye cosmetics from the eye area of users without the need for excessive rubbing and friction. Such an apparatus is preferably embodied as a lash cleaning slip which ensures effective and safe cleansing of the eyelashes specifically, removing the need to excessively rub the entire eye area to remove cosmetics commonly applied to the eye area. Unlike conventional cosmetic cleaning wipes found in the prior art, such an apparatus is preferably configured to slide over both the index finger and thumb of a user to facilitate cleansing of the eye area while minimizing excessive rubbing and irritation.

SUMMARY OF THE PRESENT INVENTION

The present invention is a cosmetic removal device specifically designed for use on eyelashes. The apparatus is equipped with dual slits, one disposed at each end of the apparatus. The slits are configured to slip over the index finger and thumb of a user, which creates a controlled method by which eye makeup, dirt particles, dust, build-up, and potential bacteria may be removed from eyelashes via an easy-gliding motion. In contrast to conventional cosmetic wipes configured for makeup removal which employ a traditional cloth and excessive rubbing for effective removal of makeup, the present invention preferably uses raw materials such as cotton, bamboo, vicrose fiber, hemp fiber, and others to facilitate and expedite makeup removal with minimal eye irritation.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

The present invention will be better understood with reference to the appended drawing sheets, wherein.

DETAILED DESCRIPTION OF THE PREFERRED EMBODIMENT

The present specification discloses one or more embodiments that incorporate the features of the invention. The disclosed embodiment(s) merely exemplify the invention. The scope of the invention is not limited to the disclosed embodiment(s).

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, Further, when a particular feature, structure, or characteristic is described in connection with an embodiment, it is submitted that it is within the knowledge of one skilled in the art to effect such feature, structure, or characteristic in connection with other embodiments whether or not explicitly described.

Figure 1:
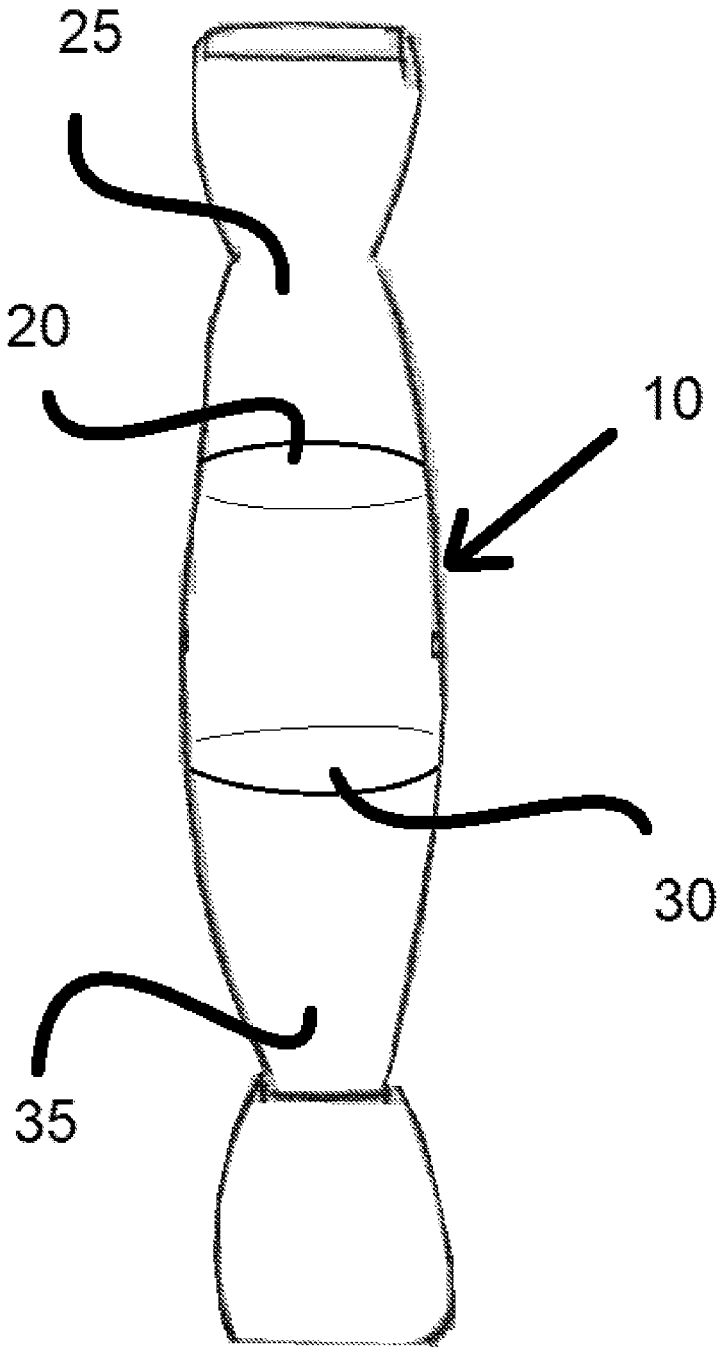
FIG. 1 depicts a view of the present invention as seen from the rear, isolated from use.
Figure 2:
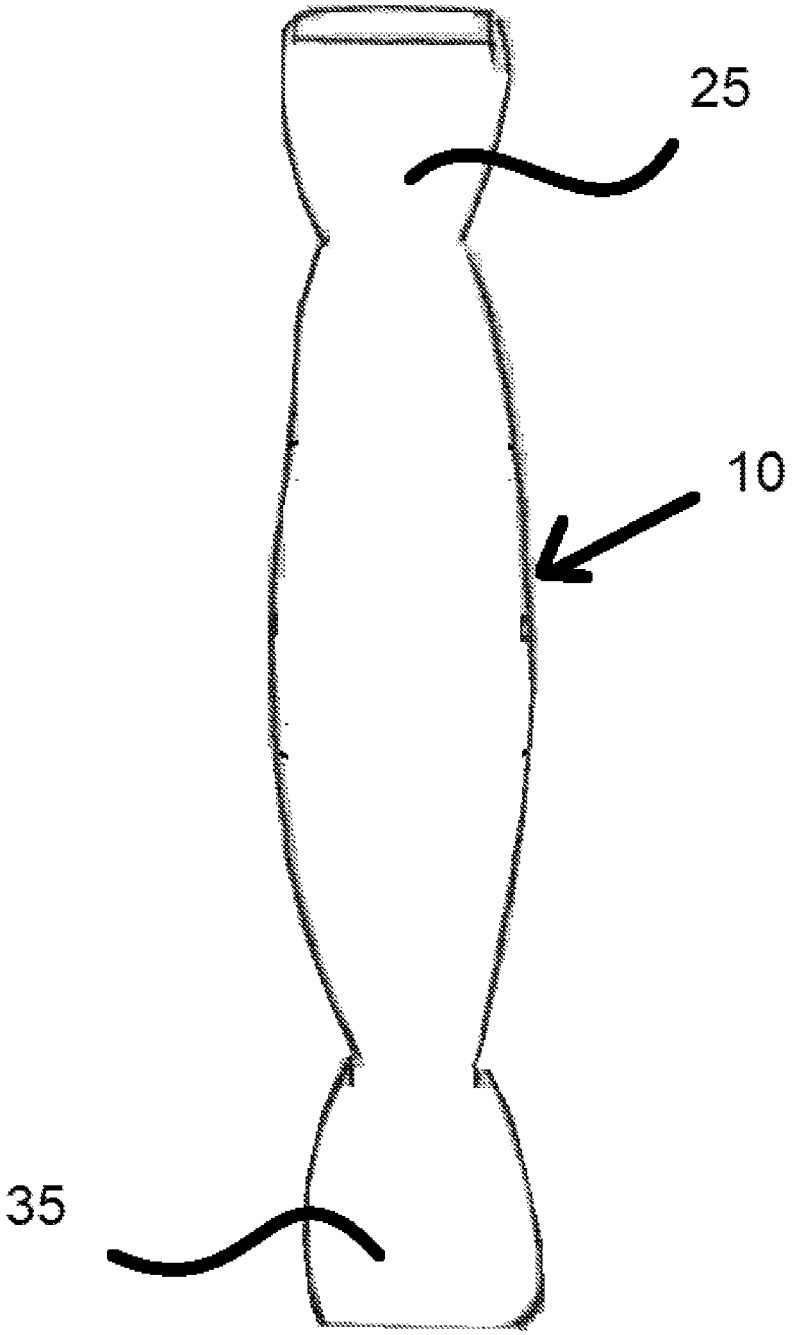
FIG. 2 exhibits a view of the present invention as seen from the front, isolated from use.

The present invention is a cosmetic removal apparatus configured for use by a user to remove makeup, eyeliner, mascara, and similar makeup generally used on the eye area of an individual. The present invention has a body (10) which is preferably elongated, and is equipped with an index finger hole (20) and a thumb finger hole (30). The index finger hole (20) is disposed at a first end (25) of the body (10) and the thumb finger hole (30) is disposed at a second end (35) of the body (10). The front, as shown on FIG. 2, is preferably at least twice as thick as the rear, as shown in FIG. 1. The whole of the body (10) is preferably composed of one or more of a variety of soft raw materials, including, but not limited to: cotton, bamboo, vicrose fiber, hemp fiber, flax, kenaf, yellow kenaf, apocynum, polyester, polyester/50% vicrose combination, nylon, microfiber, and/or yieldable stretchable materials such as rubber. Additionally, manufactured, non-woven materials may also be employed in the construction of the body (10) of the present invention, including cross-lapped spunlaced (LAPP), parallel lapped spunlace, stitchbond (NAPA), Texpun PP, and/or Spunbon+meltdown+Spunbond (SMS/SMMS).

As such, both the thumb finger hole (30) and the index finger hole (20) amount to instances, present at the first end (25) and second end (35) which exhibit double layers of one or more of the above-listed materials, amounting to open-ended pockets into which the thumb and index finger are to be placed during use of the present invention.

It should be understood that the present invention is equipped with a rear side as shown in FIG. 1, and a front side as shown in FIG. 2. The rear side is equipped with the thumb finger hole (30) and index finger hole (20), and may not be equipped with as much of the natural and/or synthetic wiping material as that of the front side of the present invention.

The front side of the present invention is equipped with at least one layer of at least one of the aforementioned natural and/or synthetic wiping materials, which are to be manipulated by the fingers of the user when placed into the index finger hole (20) and thumb finger hole (30). Given the slender and elongated stature of the body (10) of the present invention, it is envisioned that the present invention remains more efficient and functional at removing eye cosmetic products from the eyelashes and eyelids of the eye itself, rather than requiring the user to rub the entire eye socket area haphazardly and repeatedly as with conventional cleansing wipes.

Potential assembly options for the apparatus of the present invention preferably include, but are not limited to: non-woven bindings such as inter-fiber adhesions established through mechanical, chemical, thermal, or solvent means or various combinations of these processes; hybrid combinations of non-woven and other films to create the apparatus; adhesives of binding agents using the "Paste Dot" coating system and "Powder Dot" system with a low-voc polymer such as copolyimide or copolyster; and other method of combining non-woven materials including calendaring, perforation, solvent bonding, through-air entanglement, emulsion adhesive (web bonding), radiant heat, pressure embossing, dry bonding with thermoplastic fibers or film, ultrasonic stitching, powdered resin binding (thermoplastic &e thermoset), dielectric, hot-melt bonding, flame bonding, and extrusion. Rubber binding methods may also be employed in the manufacturing of the apparatus of the present invention, including low viscosity rubber bond adhesives (EP30FL) or master bond (EP21Fl, two component epoxy resin system to secure bonding to rubber slip. Alternately, non-adhesive pond options may be used, such as the sue of an injection molding process including compounds of 40% glass-fiber reinforced polamide 612 compound.

The functionality of the apparatus of the present invention is preferably achieved via a specific process which is primarily applied to the front of the apparatus. Disposable, non-woven material which is pre-moistened with an amino acid ester as an emulsifier, a natural oil or wax component such as coconut oil, and/or at least one further surfactant such as water or a solution is preferably used. Disposable, non-woven dry cloth with a premix solution (provided separately) which may be dipped and applied is an alternative option preferably available to the apparatus. Similarly, a microfiber terrycloth dry cloth with a premix solution (to be applied separately) may also be used. Rubber slip base with a plastic agent to hold an interchangeable non-woven pad (which is held in place and is removable with at least one hook-and-loop fastener, hook-and-pile fasteners, or touch fasteners) which may then be disposed after a single use.

Figure 3:
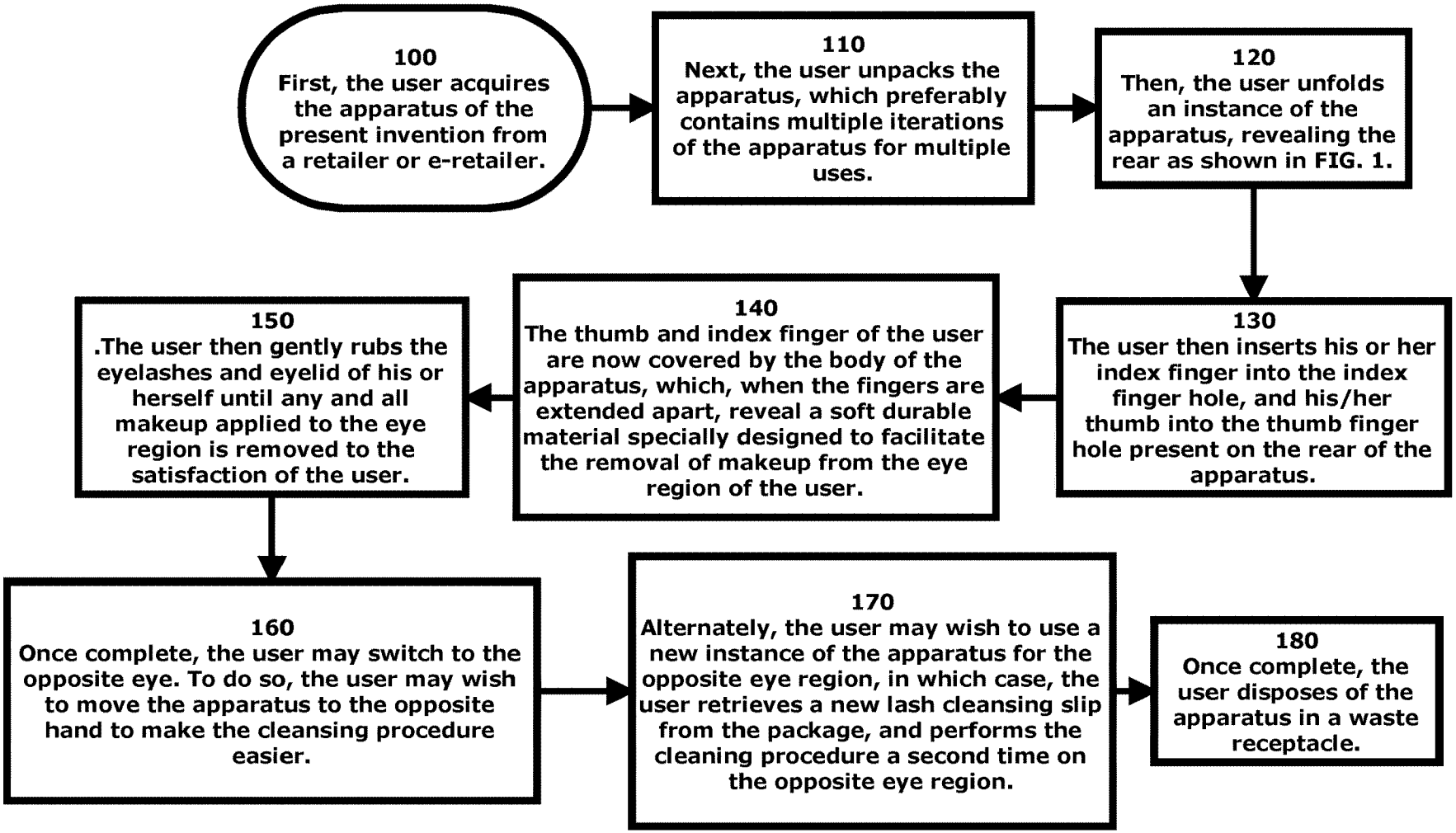
FIG. 3 shows a flow chart detailing the process of use of the present invention by a user.

The process of use of the present invention, as disclosed in FIG. 3, is preferably as follows:

1. First, the user acquires the apparatus of the present invention from a retailer or e-retailer. (100)
2. Next, the user unpackages the apparatus, which preferably contains multiple iterations of the apparatus for multiple uses. (110) Preferred embodiments of the present invention are preferably disposable, and therefore only used once.
3. Then, the user unfolds an instance of the apparatus, revealing the rear as shown in FIG. 1. (120)
4. The user then inserts his or her index finger into the index finger hole, and his/her thumb into the thumb finger hole present on the rear of the apparatus. (130) It should be noted that the index finger and thumb of the user should be on the same hand.
5. The thumb and index finger of the user are now covered by the body of the apparatus, which, when the fingers are extended apart, reveal a soft durable material specially designed to facilitate the removal of makeup from the eye region of the user. (140)
6. The user then gently rubs the eyelashes and eyelid of his or herself until any and all makeup applied to the eye region is removed to the satisfaction of the user. (150)
7. Once complete, the user may switch to the opposite eye. To do so, the user may wish to move the apparatus to the opposite hand to make the cleansing procedure easier. (160)
8. Alternately, the user may wish to use a new instance of the apparatus for the opposite eye region, in which case, the user retrieves a new lash cleansing slip from the package, and performs the cleaning procedure a second time on the opposite eye region. (170)
9. Once complete, the user disposes of the apparatus in a waste receptacle. (180)

Alternate embodiments of the present invention preferably include variations on the thickness of the body (10) of the apparatus, namely the front which comes into contact with the eye region of the user. Similarly, the size, shape, and color may vary in accordance with personal styling or desire of the manufacturer. In some embodiments, a logo or logos may be present on one or more sides of the apparatus.

It should be noted that both the front and rear of the apparatus are preferably manufactured of the same materials in the preferred embodiment of the present invention, however alternate embodiments may employ a different material for the construction of the front than that of the rear to reduce costs if found necessary. The materials used are preferably relevant to the raw materials previously noted, including cotton, bamboo, vicrose fiber, hemp fiber, flax, kenaf, yellow kenaf, apocynum, polyester, etc.

Regarding the index finger hole (20) and thumb finger hole (30), it is envisioned that both are preferably of the same depth and diameter such that they may be employed interchangeably between fingers and hands (left from right). Additionally, it should be noted that the first end (25) and second end (35) of the present invention are preferably equipped with tips (40) which are rounded in order to accommodate the circumference of the fingers themselves for a comfortable fit, and to ensure that the user is able to reach as close to the eye and nose area without injuring the eye area or pressing up against the nose bridge area of the user.

Presently, the ideal manufacturing method of the preferred embodiment of the present invention includes the use of adhesive or binding agents conventional used in a coating system such as the "paste dot" method to secure the sleeve portion (index finger hole (20) and thumb finger hole (30)) in place. As an alternative method, stitching may be used when the apparatus is composed of microfiber or similar heavy material. It should also be noted that the body (10) of the present invention, being configured to accept a first finger and second finger via the index finger hole (20) and thumb finger hole (30) is preferably approximately as wide as a finger, not to exceed one inch in width. It should be noted that the present invention is configured for use with both natural and false lash extensions.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A cosmetic cleansing apparatus for use on the eye area of a user with a hand of the user comprising:

a body, said body generally elongated, having a front and a rear;

a first finger hole, said first finger hole disposed on a first end of said body, on said rear;

a second finger hole, said second finger hole disposed on a second end of said body, on said rear, opposite said first finger hole;

wherein said first end and said second end are separated from said body by a narrow portion;

wherein said first finger hole is configured to accept an index fingertip of the hand of the user;

wherein said second finger hole is configured to accept a thumb tip of the hand of the user;

wherein said first finger hole and said second finger hole are only large enough to accommodate a single finger each;

wherein said front is at least twice as thick as said rear;

wherein said front is configured to facilitate the removal of cosmetics including mascara, eyeliner, and makeup from the eye area with minimal rubbing;

wherein said first end and said second end are tips, separate from said first finger hole and said second finger hole;

wherein said body is approximately the width of one inch;

wherein said tips are rounded to accommodate the circumference of the fingers of the hand of the user;

wherein said tips are disposed on said first end and said second end of said body; and wherein said body exhibits an hourglass shape from said first finger hole towards said first end.

2. The apparatus of claim 1, wherein said body is widest at a midsection, tapering towards said tips at said first end and said second end.

3. A cosmetic cleansing apparatus for use on the eye area of a user with a hand of the user comprising:

a body, said body generally elongated, having a front and a rear;

a first finger hole, said first finger hole disposed on a first end of said body, on said rear;

a second finger hole, said second finger hole disposed on a second end of said body, on said rear, opposite said first finger hole;

wherein said first end and said second end are separated from said body by a narrow portion;

wherein said first finger hole is configured to accept an index fingertip of the hand of the user;

wherein said second finger hole is configured to accept a thumb tip of the hand of the user;

wherein said first finger hole and said second finger hole are only large enough to accommodate a single finger each;

wherein said front is at least twice as thick as said rear;

wherein said body is composed of at least one material selected from the following group: cross-lapped spunlaced (LAPP), parallel lapped spunlace, stitchbond (NAPA), Texpun PP, and Spunbon+meltdown+Spunbond (SMS/SMMS);

tips, said tips disposed on said first end and said second end of said body;

wherein said body exhibits an hourglass shape from said second finger hole towards said second end; and wherein said tips are separate from said first finger hole and said second finger hole.

4. The apparatus of claim 3, wherein said body is widest at a midsection, tapering towards said tips at said first end and said second end.

5. A cosmetic cleansing apparatus for use on the eye area of a user with a hand of the user comprising:

a body, said body generally elongated, having a front and a rear;

a first finger hole, said first finger hole disposed on a first end of said body, on said rear;

a second finger hole, said second finger hole disposed on a second end of said body, on said rear, opposite said first finger hole;

wherein said first end and said second end are separated from a midpoint of said body by a narrow portion;

wherein said first finger hole is configured to accept an index fingertip of the hand of the user;

wherein said second finger hole is configured to accept a thumb tip of the hand of the user;

wherein said first finger hole and said second finger hole are only large enough to accommodate a single finger each;

wherein said front is at least twice as thick as said rear;

wherein said first end and said second end are tips, separate from said first finger hole and said second finger hole;

wherein said tips are disposed on said first end and said second end of said body;

wherein said body exhibits an hourglass shape from said second finger hole towards said midpoint;

wherein said body exhibits an hourglass shape from said first finger hole towards said midpoint;

wherein said body is widest at said midpoint, tapering towards said tips at said first end and said second end wherein said tips are separate from said first finger hole and said second finger hole;

wherein said tips are rounded to accommodate the circumference of the fingers of the hand of the user; and wherein said first finger hole and said second finger hole are spaced apart with said body disposed between them.

* * * * *